United States Patent [19]

Neumann et al.

[11] 4,031,580

[45] June 28, 1977

[54] INFLATABLE BOAT

[75] Inventors: Henning Neumann, Germering; Fritz Federer, Turkenfeld, both of Germany

[73] Assignee: Metzeler Kautschuk AG, Munich, Germany

[22] Filed: Apr. 8, 1976

[21] Appl. No.: 675,056

[52] U.S. Cl. ..... 9/2 A; 9/1.4

[51] Int. Cl.[2] ..... B63B 7/08

[58] Field of Search ..... 9/1.4, 2 A, 2 S, 2 C, 9/11 A; D12/63; 115/25

[56] References Cited

UNITED STATES PATENTS

| | | | |
|---|---|---|---|
| 2,803,837 | 8/1957 | Virobik | 115/25 X |
| 2,873,459 | 2/1959 | März | 9/2 A |
| 3,497,887 | 3/1970 | Bureau, Jr. | 9/6 P |

OTHER PUBLICATIONS

Popular Mechanics, vol. 107, No. 3, Mar. 1957, p. 123.

*Primary Examiner*—Trygve M. Blix
*Assistant Examiner*—Sherman D. Basinger
*Attorney, Agent, or Firm*—Michael J. Striker

[57] ABSTRACT

A deck portion of an inflatable boat has, when inflated, a plurality of alternating external bulges and grooves extending substantially longitudinally of the boat and diverging at the front part of the deck portion in the rearward direction of the boat so as to be spaced the greatest transverse distance at an access opening in which a user of the boat sits to thereby laterally divert water splashing on the deck during travel of the boat. A rigid seat shell is received in the opening and supported in the deck and hull portions of the boat. A collar surrounds the access opening and has a sealing portion which sealingly contacts a portion of the seat shell to prevent seepage of water between the collar and the seat shell. The seat shell may be used as a container for accommodating the deflated and folded boat. The seat may be equipped with a carrying belt so that it can be transported on the back of the user. The front part of the deck portion may be provided with cutouts at the regions at which the knees of the user are located during use of the boat, which cutouts are sealingly closed by outwardly bulging members.

34 Claims, 9 Drawing Figures

Fig. 6
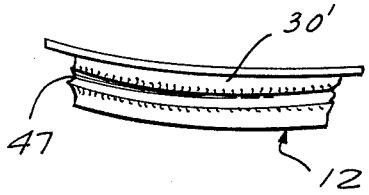
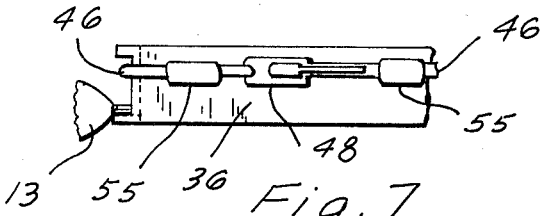
Fig. 7
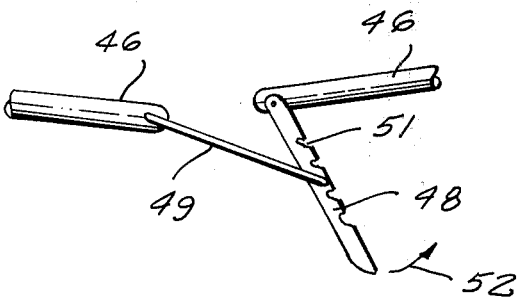
Fig. 8
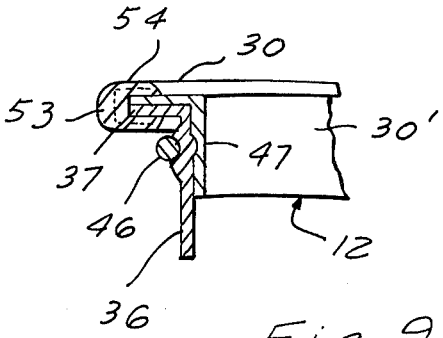
Fig. 9

INFLATABLE BOAT

BACKGROUND OF THE INVENTION

The present invention relates to an inflatable boat, particularly an inflatable kayak.

Inflatable boats are already well known, and usually they include a boat body of fiber-reinforced or fabric-reinforced natural or synthetic rubber or of flexible synthetic plastic materials. The body of the boat is conventionally formed with tubular elements which extend generally in the longitudinal direction of the inflatable boat. When the tubular elements are inflated, they give the necessary rigidity to the boat body. It is also already known to form the tubular elements as portions of the body of the boat, such as by making the body of two superimposed layers which are connected to one another at selected regions so as to provide the tubular elements. The deck portion of the body is usually provided with at least one access opening which communicates the interior of the boat with its exterior and in which there may be accommodated a rigid seat.

The German utility Pat. No. 1,696,469 published Mar. 21, 1955 discloses an inflatable kayak in which the entire body is subdivided into a plurality of interconnected tubular elements and in which the user of the kayak sits on a cushion which is preferably connected to the body. Such an inflatable kayak, however, did not find widespread use inasmuch as it is possessed of some serious drawbacks.

The outer contour and the dimensions of a kayak are, in general, predetermined inasmuch as they ought to correspond to the contour and dimensions of a rigid kayak which is made of a glass fiber reinforced synthetic plastic material. Thus, when the inflatable kayak is so constructed that its outer dimensions when inflated correspond to those of a rigid kayak, then there is available only a very limited amount of space in the interior of the inflatable kayak, particularly since the inflation of the tubular elements results in an increase of the space taken up by the same. Under such circumstances, the user of the kayak had to sit with almost completely outstretched legs and with forwardly extending feet, which resulted in a situation where the user of the kayak was in completely insufficient contact with the inflated kayak body. This, of course, was very disadvantageous, particularly since all driving movements and driving and steering forces are applied to the kayak body as reaction forces exercised by the body of the user. Thus, a stable position of the user relative to the kayak is an absolute necessity, which condition was not satisfied in the above-mentioned inflatable kayak, rendering the control of the kayak during its travel on a body of water less than satisfactory.

A further disadvantage of the aforementioned inflatable kayak results from the configuration of the deck portion of the kayak body. Like the remainder of the boat, the front part of the deck portion of this kayak is constituted by a plurality of tubular elements which extend substantially parallel to one another in the longitudinal direction of the boat. The tubular elements bulge not only inwardly of the kayak, but also outwardly thereof, thus forming at the outer surface of the kayak a plurality of convex bulges which alternate with grooves. Experience with this type of an inflatable kayak has shown that the grooves guide the water which splashes or spills over the front portion of the kayak directly to the user of the boat. This is particularly disadvantageous when the kayak is used in rapids or under similarly difficult conditions where water constantly spills over the front portion of the kayak and flows over the deck portion of the body of the kayak toward the user. The overflowing water accumulates in front of the user of the boat and often forms a spray which more often than not reaches the face of the user of the boat. This, of course, is not only very unpleasant, but may even constitute a hazard because the driver may be temporarily blinded by the spray and thus lose control of the boat.

In order to avoid the first of the above-discussed drawbacks, that is, the insufficient bodily contact of the user with the boat, it has already been proposed to accommodate a rigid seat in the access opening of an inflatable and foldable kayak. It is true that the provision of the rigid seat, which is connected to the deck portion of the kayak body, resulted in a better transmission of forces from the body of the user into the body of the kayak. However, since the tubular elements which form the deck portion of the kayak extend substantially parallel to one another and thus must be interrupted in the region of the access opening, this construction still leaves much to be desired, particularly as far as stability of the kayak is concerned. Even though all of the forces resulting from the movements of the user of the kayak are completely transmitted into the seat, the latter is still free to move to some extent and in an undesirable manner, together with the deck portion of the kayak, relative to the remainder of the boat body. On the other hand, even this modified inflatable kayak does not solve the problem of preventing the spill-over water from accumulating in front of, and inconveniencing and possibly endangering, the user of the kayak.

Another disadvantage encountered in the kayak construction is that spill-over water may sleep into the interior of the kayak through a gap which is present between the deck portion of the kayak and the seat.

SUMMARY OF THE INVENTION

It is a general object of the present invention to avoid the disadvantages of the prior art boats.

More particularly, it is an object of the present invention to provide a novel inflatable kayak of excellent handling properties.

It is a further object of the present invention to present a new inflatable kayak which is comparable to a rigid kayak in its behavior and its handling.

It is still another object of the present invention to provide a kayak in which the seat is sufficiently rigidly connected with the inflatable kayak body.

It is a concomitant object of the present invention to provide an inflatable boat in which the spill-over water is diverted laterally of the access opening.

A still further object of the present invention is to so construct an inflatable boat that spill-over water is prevented from entering the interior of the boat around the seat.

Yet another object of the present invention is to provide a new kayak in which the interior space is sufficiently large.

Still another object of the present invention is to provide a kayak in which the legs and feet of the user can be braced against the interior surface of the kayak body in order to obtain a secure bodily contact between the user and the boat and thus excellent transmission of forces from the user into the boat.

Finally, it is an object of the present invention to keep the advantages of an inflatable kayak, such as the small amount of space taken up by the kayak body when in its deflated and folded condition, low weight, and excellent maneuverability.

In pursuance of these objects and others which will become apparent hereafter, one feature of the present invention resides, in an inflatable boat, briefly stated, in a combination comprising an elongated body of elastically yieldable material having a deck portion and a hull portion which together bound an interior of the boat, at least one access opening in the deck portion which subdivides the deck portion into a front section and a rear section, as considered in the direction of travel of the boat, and which communicates the exterior of the boat with the interior thereof. At least one rigid seat is at least partially accommodated in the interior of the boat and has a contact portion which is received in the respective access opening. The combination further comprises means for giving the body a desired configuration when inflated, such means including a plurality of inflatable tubular elements which extend substantially longitudinally of the body. According to the invention, the tubular elements associated with the front section of the deck portion diverge in the rearward direction and form on the front section a plurality of diverging bulges alternating with grooves which are spaced the greatest transverse distance at the access opening, whereby water splashing on the deck during the travel of the boat is diverted by the bulges and grooves laterally of the access opening. The combination further comprises support means which surrounds the access opening which is operative for supporting the seat on the deck portion, and sealing means between the support means and the contact portion which is operative for preventing seepage of water into the interior of the boat between the support means and the seat.

According to a currently preferred embodiment of the present invention, the bulges diverge in the rearward direction from approximately the middle of the front part of the deck portion up to the access opening, at least some of the bulges bypassing the access opening. A seat or a seat shell can be supported on the deck portion and accommodated in the interior of the boat, the seat shell being substantially rigid.

The divergence of the tubular elements has two advantageous results. On the one hand, when the tubular elements or bulges surrounding or bypassing the access opening and the seat received therein, are inflated, the pressure inside the tubular elements causes the latter to press against the seat shell whereby the latter is securely clamped in the deck portion. On the other hand, the presence of the diverging bulges and grooves at the outer surface of the deck portion assures that the spillover water is diverted laterally or transversely of the boat so that it flows laterally along the access opening and thus does not accumulate in front of the user of the kayak. To improve this effect, the seat may have an upwardly curved front portion which conforms to the shape of the support means so that the latter is raised in a region thereof which is located frontwardly of the front portion of the seat.

According to a further concept of the present invention, the inflatable kayak further comprises at least one support member around the access opening, the support member being connected to the deck portion, and the seat having a marginal portion which is supported on the support member. It is currently preferred that the support member be shaped as either a substantially annular collar surrounding the access opening and sealingly connected to the region of the deck portion which surrounds the access opening, or as a plurality of lugs which are distributed around the access opening. The seat may be dismountably connected to the annular collar or to the lugs. When this type of connection to the inflatable kayak body is used, the seat shell, which is basically known and widely used in connection with rigid kayaks of glass fiber reinforced synthetic plastic materials, surprisingly improves the handling and behavior of the inflatable kayak.

The utility and useful properties of the inflatable kayak or a similar boat according to the present invention are further improved when the seat shell is configurated as a carrying or transportation container for the boat body, and when it is provided, in its marginal portion, with an arrangement to which adjustable carrier belts can be connected so that the seat shell, together with the deflated and folded boat, can be carried by the user thereof, on his back. In this manner, the user of the kayak is almost completely independent of special transportation arrangements. This enables the user to almost arbitrarily select a point of departure as well as his point of arrival, particularly since he can carry the boat in its folded state on his back to and from any location. Of course, the user of the kayak can use any public transportation carrier inasmuch as the kayak body which is neatly folded inside the shell is excellently suited for transportation. On the other hand, such folded kayak can be carried even to such locations which are inaccessible to vehicular transportation.

In order to improve sealing of a gap which may exist between the contact portion of the seat and the support means, the contact portion may be formed with an external peripheral groove, and the collar may be elastically yieldable and have a sealing portion which is pressed into the groove to seal the gap. Alternatively, or additionally, an annular sealing element may sealingly straddle radially outwardly extending portions of the collar and of the contact portion.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 6 is a side elevational view of a part of a contact portion of the seat illustrated in FIG. 1;

FIG. 7 is a view similar to FIG. 6 but illustrating a corresponding part of a collar;

FIG. 8 is a top plan view of a detail of an arrangement for connecting the seat to the collar; and FIG. 9 is a partial cross-sectional view of an arrangement for sealing a gap between the seat and the collar.

DETAILED DISCUSSION OF THE PREFERRED EMBODIMENTS

Figure 1:
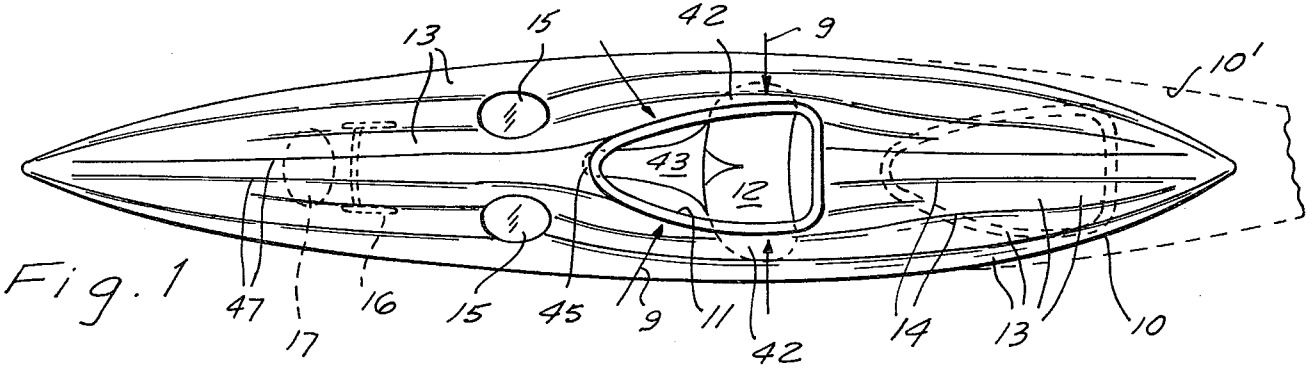
FIG. 1 is a top plan view of an inflated kayak of the present invention.

Referring now to the drawings and first to the FIG. 1 thereof, it may be seen that the reference numeral 10 has been used to designate a body of a one-seat boat, whereas reference numeral 10' identifies an extension of the body 10 which is present in a two-seat boat. The body 10 is provided in its deck portion with an access opening 11 in which there is received a rigid seat shell 12. Similarly, the extension 10' is provided with an access opening 11', and a seat shell 12' is received therein. The boat deck is constituted by a plurality of individual tubular elements 13 which extend substantially longitudinally of the boat body 10 and/or of the extension 10' and are connected to one another. The tubular elements 13 are of an elastically yieldable material, such as fiber-reinforced material or synthetic rubber or a flexible synthetic plastic material, to be inflatable. Each of the tubular elements 13 can be inflated independently of the other tubular elements 13 or all of the tubular elements 13 can be inflated simultaneously. Advantageously, the tubular elements 13 are constituted by joined portions of two superimposed layers of the elastically yieldable material, which layers also constitute the body 10. Beginning approximately in the middle of the front section of the deck portion, the tubular elements 13 diverge rearwardly and sidewardly, at least some of the tubular elements 13 bypassing the access opening 11 so that curved portions of the tubular elements 13 surround the access opening 11. When the tubular elements 13 are inflated, the pressure of the inflating medium, in most instances air, exerts clamping forces on the seat shell 12 in the directions of the arrows 9, such clamping forces resulting in stiffening of the entire boat body 10, thus giving the body 10 the necessary dimensional stability. Of course, a similar situation also exists, when the body 10 has the extension 10', with respect to the clamping of the seat shell 12' in the access opening 11'.

The tubular elements 13 alternate with grooves 14 which act as guiding channels for the spill-over water which flows over the deck portion of the boat body 10. Because of the divergence of the tubular elements 13 in the front section of the body 10, the grooves 14 also diverge in the rearward direction of the boat body 10 so that the water flowing over the front section of the deck portion is diverted laterally and flows along the opening 11 sidewardly of the body 10.

In the region at which it is assumed that the knees of a person sitting in the boat will be located, there are provided cutouts 15 which will be discussed in greater detail later on. Foot supports 16 or a support cushion 17 are arranged at the location where the feet of the user will be during the use of the boat.

The tubular elements 13 can either be continuous from the front to the rear of the body 10 and/or the extension 10' as illustrated in the upper part of FIG. 1, but it is equally conceivable that at least some of the tubular elements 13 may be interrupted in the region of the access opening 11 and/or the access opening 11'. The lower part of FIG. 1 illustrates this possibility, this expedient resulting in a situation in which the water which flows through the grooves 14 is forced to flow laterally and off the deck portion. It is further currently preferred if the central tubular element 13 which extends from the front of the boat to the opening 11 is relatively wide and high at the opening 11 so that it acts as a wave deflector.

Figure 2:
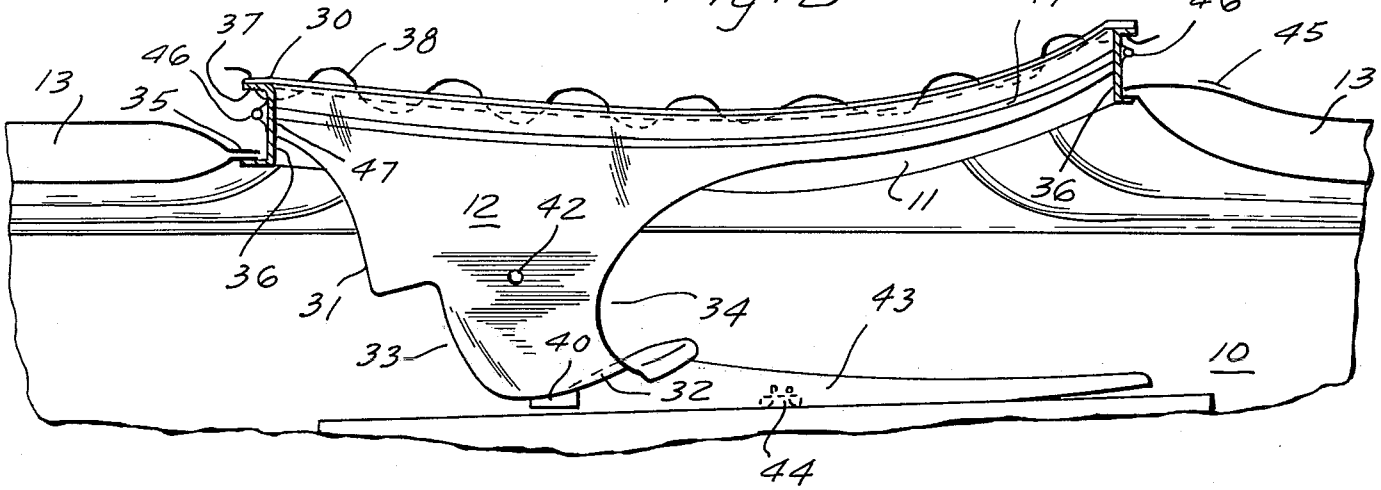
FIG. 2 is a longitudinal fragmented sectional view of a central portion of the kayak.

FIG. 2 shows the arrangement of the seat shell 12 in the opening 11. The seat shell includes an upper annular marginal portion 30, a backrest portion 31 and a seat portion 32. The seat shell 12 of the currently preferred embodiment is of one piece and formed of a fiber-reinforced synthetic plastic material, such as a polyester reinforced with glass fibers. Of course, the seat shell 12 may equally likely be made of another material suitable for such purposes, such as light metal, a different synthetic plastic material, wood or similar materials. The seat shell 12 has a small opening 33 in the region of the backrest portion 31, and a large opening 34 in its front region for the legs of the user.

The tubular elements 13 are joined in the region of the opening 11 by a flat joint 35 in which there is connected, according to a currently preferred concept of the present invention, a C-shaped profiled element 36 of a proper flexible material, the profiled element 36 extending outwardly of the contour of the boat body 10 and forming a collar. The profiled element 36 has two arms and a web interconnecting the two arms, the arms extending radially outwardly of the web. One of the arms is connected to the joint 35, whereas the other arm 37 supports the marginal portion 30 of the seat shell 12. Further details of the profiled element 36 will be discussed later.

The marginal portion 30 can be connected to the arm 37 in a dismountable manner, such as by means of a rope 38. However, it is to be understood that any other method of connecting these two parts can be selected, such as those utilizing snap fasteners or hooks. This particular arrangement for connecting the seat shell 12 to the boat body 10 renders it possible, at the other hand, to effectively transmit forces which are especially advantageous from the point of view of controlling the speed and direction of travel of the boat, from the user to the seat shell 12, from there to the marginal portion 30 of the seat shell 12 which projects outwardly of the contour of the boat body 10 and finally to the boat body 10 itself. On the other hand, the outwardly projecting profiled element 36 acts as a deflector for the water which flows along the boat deck portion.

This action of the profiled element 36 is further enhanced when a front portion of the seat shell 11 as seen in the longitudinal direction of the boat during its travel, is raised in a curved manner as indicated in FIG. 1. In that event, the profiled element 36 conforms to the shape of the front portion of the seat shell 11, that is, it is also raised due to the action of the rope 38 or similar connecting arrangement so that the deflecting action of a portion 45 of at least the central one of the tubular elements 13 is improved. While the present invention has been described as embodied in a kayak for use by a single user, it is equally possible to embody the concepts of the present invention in a double kayak by providing, as discussed above, two separate openings 11 and 11' arranged behind one another in the longitudinal direction of the body 10 and the extension 10' thereof, a seperate seat shell 12 and 12' being accommodated in each of the openings 11 and 11'. An arrangement similar to that discussed in connection with a single or a double kayak can also be used in a different type of a boat, such as a single or a double canoe.

Furthermore, a flexible portion or an apron which is conventionally used in connection with kayaks or other boats and thus has not been illustrated, can be drawn over the marginal portion 30 of the seat shell 12, to be sealingly received in the recess bounded by the arms and web of the C-shaped profiled element 36, the apron serving the purpose of preventing water from flowing or seeping into the interior of the boat body 10 even when the kayak travels through difficult rapids or is otherwise subjected to extreme water conditions.

When the boat body 10 is to be folded, the rope 38 is loosened or even removed and the seat shell 12 is removed from the interior of the boat body 10 through the opening 11. Then, the tubular elements 13 are deflated so that afterwards the boat body 10 can be folded into a handy package.

Figure 3:
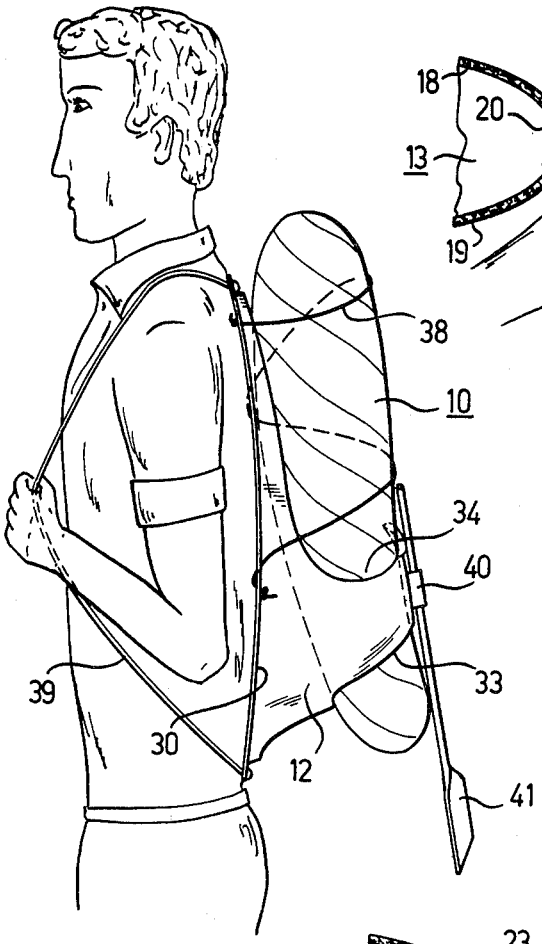
FIG. 3 is a view of the kayak carried by a user in its folded condition.

It is shown in FIG. 3 that the seat shell 12 can be used as a transporting and carrying container for the deflated and folded boat body 10. In accordance with the currently preferred embodiment of the present invention, carrying belts 39 can be hooked or otherwise connected to the marginal portion 30 of the seat shell 12 in such a manner that the seat shell 12 can be carried, in a manner resembling that of carrying a backpack, on the back of the user. In order to secure the folded boat body to the seat shell 12, the folded boat body 10 is partially passed through the small opening 33 of the seat shell 12 in the illustrated manner, and then connected to the seat shell 12 by means of the rope 38. In order to further improve the transportation of the boat, the lower part of the seat shell is provided with a connecting arrangement 40 for a paddle 41. To improve the comfort of the person transporting the folded boat body 10, it is proposed according to a further aspect of the present invention to make the contour of the marginal portion 30 of the seat shell 12 slightly arcuate as illustrated in the drawing.

Figure 4:
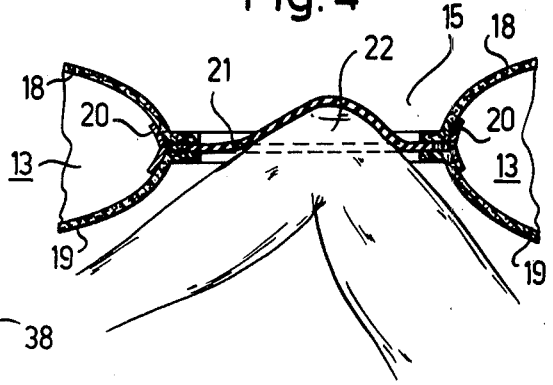
FIG. 4 is a longitudinal sectional view of a knee region of the deck portion according to FIG. 1 showing one type of a closing arrangement.

The cutouts 15 which have already been mentioned previously are illustrated at a larger scale in FIG. 4. In order to obtain such cutouts 15, the air-impermeable layers 18 and 19 are in this embodiment connected to one another with the interposition of a connecting strip 20 so that the region of the connection of the layers 18 and 19 which form the tubular elements is air-tight. Thereafter, parts of the layers 18 and 19 are removed to provide holes which are subsequently air-tightly and water-tightly closed by a diaphragm 21. Preferably, the layers 18 and 19 may be sealingly glued to one another, and the elastic diaphragm 21 can be connected to the region of the boat deck portion which surrounds the cutouts 15 by being glued to one or the other of the layers 18 and 19, preferably to both of them when interposed between the layers 18 and 19. An alternative method of connecting the diaphragm 21 to the layers 18 and 19 is sewing. By providing the cutouts 15 and the diaphragms 21 closing the same, it is achieved that the user can press his knee 22 against this diaphram 21, bulging the same outwardly at least under some circumstances so that sufficient space is available to the user for necessary movements or adjustments of his position, while the sealing connection of the diaphragm 15 to the deck portion of the boat body 10, and more particularly to the layers 18 and 19, prevents water from flowing to the interior of the boat body 10.

Figure 5:
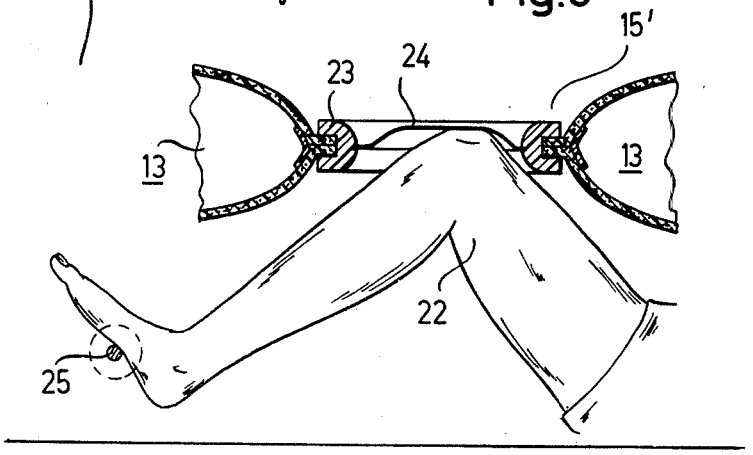
FIG. 5 is a view similar to FIG. 4 but showing a different closing arrangement.

FIG. 5 illustrates a different embodiment of a cutout 15' similar to the above-discussed cutout 15. In this embodiment, the cutout 15' is closed by means of a shaped member 23 having a rigid edge portion which is resistant to tensile stresses and capable of withstanding the stresses in the tubular elements 13 resulting from the inflation thereof without damage to itself or to the tubular elements 13. A sealing portion 24, such as a diaphragm or a cup-shaped portion, or a rubber skin, is sealingly connected to the edge portion of the shaped member 23.

The user of the kayak may rest or brace his feet against a foot support 25 which is arrested in a given position by being connected at both sides to the walls of the boat body 10 which are constituted by the tubular members 13 and which bound the boat interior. The foot support 25 may be constituted by different elements which are known per se, such as a rope whose length can be adjusted, a belt, or even an inflatable or fillable cushion.

Referring now to FIGS. 1 and 2, it may be seen therein that the seat shell 12 has lateral abutment portions 42 and a central abutment portion 43 in form of a bracket or of a plate, which abutment portions somewhat increase the dimensions of that part of the seat shell 12 which is accommodated in the interior of the boat body 10. When the seat shell 12 is received in the interior of the boat body 10, the abutment portions 42 and 43 are in contact with the lateral or the bottom walls of the hull portion of the boat body 10. This contact of the abutment portions 42 and 43 with the hull portion of the boat body 10 improves the stability of the seat shell 12 relative to the boat body 10.

Connecting elements 44 and 44' may be provided, which respectively connect the abutment portions 42 and 43 to the hull portion of the boat body 10. When such connecting elements 44 and 44' are provided, being of conventional construction, then the seat shell 12 can be extremely securely connected to the hull portion of the boat body 10. However, it is to be understood that only the lateral abutment portions 43 or only the central abutment portion 42 may be provided, and none, some or all of the abutment portions 42 and 43 may be connected to the hull portion of the boat body 10 by the respective connecting elements 44 and 44'. As mentioned above, the dimensions of the seat shell 12, including the abutment portions 42 and 43 thereof, are somewhat larger than the pass-through cross-sectional area of the opening 11. Therefore, in order to introduce the seat shell 12 into, and remove the same from, the interior of the boat body 10, it is necessary to tilt the seat shell 12 relative to the boat body 10, which requires some skill on the part of the user of the boat. However, this is only a small inconvenience which is fully compensated for by the more secure and stable positioning of the seat shell 12 in the interior of the boat body 10.

As seen in FIG. 2, an elongated tightening element 46, such as a resiliently yieldable rope or a tensionable band, extends peripherally of the profiled element 36 at the outer circumferential surface thereof. The tightening element 46 can be connected to the profiled element 36, such as by being vulcanized thereto or by being received in loop-shaped receiving elements 55 which are shown in FIG. 7.

The tightening element 46 presses against profiled element 36, and thus urges the latter against a contact portion 30' of the seat shell 12 which is juxtaposed with the profiled element 36. The contact portion of the seat 12, as particularly seen in FIG. 6, is formed with a receiving arrangement 46, such as an annular groove which extends peripherally of the contact portion of the seat shell 12. Thus, the portion of the elastically yieldable profiled element which is pressed by the tightening element 46 into the groove 47 seals the interface between the seat shell 12 and the profiled element 36 so that water which may spill over the boat body 10 is efficiently prevented from seeping into the interior of the boat body and through the interface.

FIG. 6 illustrates a fragment of an upper portion of the seat shell 12 in which the above-mentioned contact portion is designated with reference numeral 30'. As illustrated, the annular groove 47 is formed in an outwardly bulging portion of the contact portion 30'; however, when the thickness of the contact portion 30' permits, the outer peripheral surface of the contact portion 30' could be flat and the groove 47 could be fully recessed into the interior of the contact portion 30' with respect to the outer peripheral surface of the contact portion 30'. Preferably, the groove 47 has a generally U-shaped cross section.

The cooperation of the contact portion 30' of the seat shell 12 with the collar-shaped profiled element 36 of the boat body 10 is illustrated in particular in FIG. 7. As mentioned above, the tightening element 46 is either vulcanized to or supported on the profiled element 36 by means of loop-shaped elements 55. As also indicated, the elongated tightening element 46 can be tensioned, by adjusting the length thereof, by means of a tensioning arrangement 48.

FIG. 8 illustrates one possible embodiment of the tensioning arrangement which includes a tensioning bracket 48 which is pivotally connected to one end of the elongated tightening element 46. The bracket 48 is provided with recesses 51, and a connecting element 49 which is formed with a portion capable of engaging in the recesses 51 is also pivotally connected to the other end of the elongated tightening element 46. When the bracket 48 is in the open position thereof, the two ends of the elongated tightening elements 46 are spaced from one another so that the profiled element 36 is disengaged from the contact portion 30' of the seat shell 12. Provided at the contact portion 30' of the seat shell 12 is in the proper position thereof with respect to the profiled element 36, the connecting element 49 can be engaged in one of the recesses 51 of the bracket 48 and the latter can be moved in the direction of an arrow 52 which results in tensioning of the tightening element 46 and, consequently, in pressing of a portion of the elastically yieldable profiled element 36 into the annular groove 47. Instead of being equipped with a plurality of recesses 51, the bracket 48 can also have only one recess 51 which is so situated with respect to the bracket 48 that the elongated element 46 will be properly tensioned once the bracket 48 is fully moved in the direction of the arrow 52.

FIG. 9 illustrates a further possibility of sealing the critical region between the contact portion 30' of the seat shell 12 and the profiled element 36 as illustrated in FIG. 9. This possibility can be used in addition to or instead of the previously discussed sealing of the interfact between the contact portion 30' of the seat shell 12 and the profiled element 36 which is connected to the boat body 10. In this embodiment, the marginal portion 30 of the seat shell 12 is in contact with the arm 37 of the profiled element 36, and a ring-shaped sealing element 53 straddles the marginal portion 30 and the arm 37 in sealing contact therewith. The sealing element 53 is of a U-shaped configuration, and may have a reinforcement 54 embedded therein which urges the arms of the U-shaped sealing element toward one another so that they press against the marginal portion 30 and the arm 37, respectively.

All of the above-discussed expedients should be considered in connection with one another, since they together serve the purpose of improving the handling of an inflatable kayak and its safety in operation and comfortability.

It will be understood that each of the elements described above, or two or more together, may also find a useful application in other types of constructions differing from the types described above.

While the invention has been illustrated and described as embodied in an inflatable kayak or a similar boat it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claim:

1. In an inflatable boat, a combination comprising an elongated body of elastically yieldable material having a deck portion and a hull portion which together bound an interior of the boat; at least one access opening in said deck portion subdividing the latter into a front section and a rear section as considered in the direction of travel of the boat and communicating the exterior of the boat with said interior; means for giving said body a desired configuration, including a plurality of inflatable tubular elements extending substantially longitudinally of said body, the tubular elements associated with said front section of said deck portion diverging in rearward direction and forming on said front section a plurality of diverging bulges alternating with grooves which are tranversely spaced by a distance which is greatest at said access opening; support means surrounding said access opening, including an elastically yieldable collar-shaped support member connected to said deck portion around said access opening and having an inner and an outer circumferential surface; at least one rigid seat at least partially accommodated in said interior and having a contact portion received in the respective access opening and a marginal portion supported on said support member; sealing means between said inner circumferential surface of said support member and said contact portion of said seat and operative for preventing seepage of water into said interior between the former and the latter; and connecting means for dismountably connecting said seat to said support member, including a ring-shaped element surrounding said support member at said outer circumferential surface thereof, and means for urging said ring-shaped element against said outer circumferential surface to thereby press said sealing means into sealing contact with said contact portion of said seat.

2. A combination as defined in claim 1, wherein said ring-shaped element is permanently connected to said support member at said outer circumferential surface thereof.

3. A combination as defined in claim 1, wherein said ring-shaped element is an elongated rope extending circumferentially of the support member and wherein said urging means includes means for adjusting the length of said rope to thereby vary the force with which the latter presses said sealing means against said contact portion.

4. A combination as defined in claim 3, and further comprising means for permanently attaching said rope to said support member.

5. A combination as defined in claim 4, wherein said attaching means includes a plurality of loops connected to said support member and embracing said rope.

6. A combination as defined in claim 1, wherein said ring shaped element is resiliently yieldable.

7. In an inflatable boat, a combination comprising an elongated body of elastically yieldable material having a deck portion and a hull portion which together bound an interior of the boat; at least one access opening in said deck portion subdividing the latter into a front section and a rear section as considered in the direction of travel of the boat and communicating the exterior of the boat with said interior; means for giving said body a desired configuration, including a plurality of inflatable tubular elements extending substantially longitudinally of said body, the tubular elements associated with said front section of said deck portion diverging in rearward direction and forming on said front section a plurality of diverging bulges alternating with grooves which are transversely spaced by a distance which is greatest at said access opening; support means surrounding said access opening, including a support collar having a substantially C-shaped cross section, sealingly connected to a marginal region of said deck portion of said body which surrounds said access opening, and extending to the exterior of said body; at least one rigid seat at least partially accommodated in said interior and having a contact portion received in the respective access opening and a marginal portion supported on said support collar; and sealing means between said support collar and said contact portion and operative for preventing seepage of water into said interior between the former and the latter.

8. A combination as defined in claim 7, wherein said collar has two arms extending in substantially parallel planes, and a web interconnecting said arms; and wherein said arms extend radially outwardly from said web.

9. A combination as defined in claim 8, wherein one of said arms is rigidly connected to said marginal region; and wherein said marginal portion is supported on the other arm of said collar.

10. A combination as defined in claim 9, wherein said sealing means includes an annular sealing element which sealingly straddles said marginal portion of said seat and said other arm of said collar.

11. A combination as defined in claim 7, wherein said collar is of an elastically yieldable material.

12. A combination as defined in claim 11, wherein said contact portion of said seat is annular and has an outer peripheral surface formed with an annular recess; wherein said sealing means includes a sealing portion of said collar; and further comprising means for urging said sealing portion into said recess to thereby prevent seepage of spill-over water between said annular contact portion and said collar.

13. In an inflatable boat, a combination comprising an elongated body of elastically yieldable material having a deck portion and a hull portion which together bound an interior of the boat; at least one access opening in said deck portion subdividing the latter into a front section and a rear section as considered in the direction of travel of the boat and communicating the exterior of the boat with said interior; at least one rigid seat at least partially accommodated in said interior and having a contact portion received in the respective access opening; means for giving said body a desired configuration including a plurality of inflatable tubular elements extending substantially longitudinally of said body, the tubular elements associated with said front section of said deck portion diverging in rearward direction and forming on said front section a plurality of diverging bulges alternating with grooves which are transversely spaced by a distance which is greatest at said access opening; support means surrounding said access opening and operative for supporting said seat on said deck portion; sealing means between said support means and said contact portion and operative for preventing seepage of water into said interior between the former and the latter; cutouts at the regions of said deck portion at which the knees of the user of the boat are to be located during the use of the boat; and means for sealingly closing said cutouts.

14. A combination as defined in claim 13, wherein said closing means includes an elastically yieldable diaphragm sealingly connected to said deck portion of said body at each of said cutouts.

15. A combination as defined in claim 13, wherein said closing means includes a cup-shaped member having a rim, the latter being sealingly connected to said deck portion of said body at each of said cutouts, the cup-shaped member bulging outwardly of its associated cutout.

16. In an inflatable boat, particularly for use on rough waters, a combination comprising an elongated body of elastically yieldable material having a deck portion and a hull portion which together bound an interior of the boat; means for giving said body a desired configuration, including a plurality of inflatable tubular elements extending substantially longitudinally of said body; at least one access opening in said deck portion subdividing the latter into a front section and a rear section as considered in the direction of travel of the boat and communicating the exterior of the boat with said interior; at least one rigid seat at least partially accommodated in said interior and having a contact portion received in the respective access opening; support means connected to said deck portion so as to surround said access opening and operative for supporting said seat on said deck portion; means for diverting water which spills over said deck portion laterally away from said access opening, including a plurality of grooves on said deck portion which diverge from one another at least on said front section of said deck portion in direction toward said access opening, and raised zones of said support means and of said front section located frontwardly of said access opening and centrally of the boat and sloping down in the transversely outward directions; and sealing means between said support means and said contact portion and operative for preventing seepage of water into said interior between the former and the latter.

17. A combination as defined in claim 16, wherein some of said tubular elements are associated with said deck portion and form a plurality of bulges thereon which bound said grooves between themselves.

18. A combination as defined in claim 17, wherein at least some of said bulges laterally bypass said access opening.

19. A combination as defined in claim 17, wherein said tubular elements diverge at least from approximately the middle of said front section of said deck portion toward said access opening.

20. A combination as defined in claim 17, wherein said material is selected from the group consisting of fiber-reinforced natural rubber, fiber-reinforced synthetic rubber and a flexible synthetic plastic material.

21. A combination as defined in claim 17, wherein said tubular elements are rigidly connected with said body.

22. A combination as defined in claim 17, wherein said body includes two superimposed layers of said elastically yieldable material; and wherein said tubular elements are constituted by joined portions of said superimposed layers.

23. A combination as defined in claim 16, wherein said support means comprises at least one support member around said access opening and connected to said deck portion; and wherein said seat has a marginal portion supported on said support member.

24. A combination as defined in claim 23, and further comprising connecting means for dismountably connecting said seat to said support member.

25. A combination as defined in claim 24, wherein said seat has an upwardly curved front portion; and wherein said connecting means connects said seat to said support member for raising said raised zones in conformity with said upwardly curved front portion of said seat.

26. A combination as defined in claim 16, wherein said seat is a one-piece member including a back-rest portion and a seat portion.

27. A combination as defined in claim 26, wherein said seat further comprises means for holding paddles, said means being arranged underneath said seat portion when said seat is accommodated in said interior of said body.

28. A combination as defined in claim 16, wherein said seat is of a fiber-reinforced synthetic plastic material.

29. A combination as defined in claim 28, wherein said material of said seat is polyester.

30. A combination as defined in claim 16, wherein said seat is shaped as a container for accommodating said body therein when deflated and folded.

31. A combination as defined in claim 30, further comprising at least one carrying belt; and wherein said seat further includes means for connecting said carrying belt thereto so that said seat can be transported on the back of the user.

32. A combination as defined in claim 16, and further comprising additional support means for supporting said seat in said hull portion.

33. A combination as defined in claim 32, wherein said additional support means includes at least one extension rigidly connected to said seat and bracing against said hull portion when said seat is accommodated in said interior.

34. A combination as defined in claim 33; and further comprising additional connecting means for connecting said extension to said hull portion.

* * * * *